United States Patent [19]

Khorsand

[11] Patent Number: 4,599,007

[45] Date of Patent: Jul. 8, 1986

[54] RECIPROCATING DRIVE MECHANISM

[76] Inventor: Hossein Khorsand, 25561 Via Inez, San Juan Capistrano, Calif. 92675

[21] Appl. No.: 658,672

[22] Filed: Oct. 9, 1984

[51] Int. Cl.[4] ..... B41J 25/28; B41J 19/50

[52] U.S. Cl. ..... 400/322; 101/93.04; 101/93.09; 400/121; 400/320; 400/352; 267/158

[58] Field of Search ..... 400/121, 322, 320, 352, 400/328; 101/93.04, 93.05, 93.09; 267/160, 158, 163

[56] References Cited

U.S. PATENT DOCUMENTS

| | | | |
|---|---|---|---|
| 4,227,455 | 10/1980 | Pennebaker | 400/124 X |
| 4,322,063 | 3/1982 | Fishbeck | 267/160 |
| 4,402,620 | 9/1983 | Kekas | 400/322 X |
| 4,461,984 | 7/1984 | Whitaker | 400/314.1 X |

FOREIGN PATENT DOCUMENTS

| | | | |
|---|---|---|---|
| 2950831 | 6/1981 | Fed. Rep. of Germany | 267/158 |

*Primary Examiner*—Paul T. Sewell
*Attorney, Agent, or Firm*—Paul F. Horton

[57] ABSTRACT

A reciprocating drive mechanism, capable of producing a substantially trapezoidal velocity profile, reciprocates the hammer banks of a dot matrix printer, or printers in general, at a relatively high frequency (40 HZ), and a high constant velocity (34 to 40 in/sec). Utilizing a set of non-linear springs, the hammer banks are reciprocated at one of the many possible resonant frequencies of the non-linear spring mass system, thus minimizing power consumption. Single action solenoids or a voice coil type motor is servo controlled to compensate for the energy loss due to damping. An optical switch establishes the zero position of the hammer banks at mid-length of the travel. A velocity transducer measures the velocities at all positions. By integrating the velocities, the positions at any time of travel is known for proper placement of the print dots.

10 Claims, 13 Drawing Figures

RECIPROCATING DRIVE MECHANISM

BACKGROUND OF THE INVENTION

1. Field of the Invention

This invention relates, in general, to reciprocating drive mechanisms for machines requiring reciprocating drives with trapezoidal velocity profiles, and in particular, to reciprocating drive mechanisms for dot matrix printers having hammer banks.

2. Description of the Prior Art

For maximum thruput of a dot matrix printer, the hammer bank must travel in the print region at substantially constant velocity. The magnitude of the constant velocity is set by the maximum frequency the hammers can operate, and the desired spacing between consecutive dots. At the end of the print region, the hammer banks must reverse their direction and reach their set constant velocity in a minimum possible time. In practice the best velocity profile (velocity vs. distance) is trapezoidal in shape, having round corners for vibration free operation. To change velocity profile of a linear spring mass system from sinosoidal to trapezoidal profile, energy must be added to and subtracted from the system in an appropriate manner.

In reference U.S. Pat. No. 3,941,051, issued to Barrus et al., a cam driven system absorbs and returns the energy to the mass by a flywheel. The performance of this system is satisfactory at relatively low velocities of 20 inches per second. At higher velocities of 30 to 40 inches per second, as required by high speed print hammers, a cam driven system requires a large drive motor and flywheel, is susceptible to excessive wear at the cam surface, and it is also susceptible to vibration.

In other types of drivers, the adding and subtracting of energy is performed by large, fast, responsive voice coil type motors aided by linear springs. A driver, as such, consumes formidable amounts of power for achieving a high amplitude trapezoidal velocity profile and requires a very large and expensive type of motor. As an alternative to the large amount of energy addition and subtraction by a linear motor, reference U.S. Pat. No. 4,180,766 issued to J. Matula, presents free traveling hammer banks moving at constant speed in the print region to impact cantilever supported flexures acting as resilient bumpers. Since the cantilever flexures are linear springs, they have linear energy absorption characteristics. They therefore fall short of achieving a high amplitude trapezoidal velocity profile. Disadvantages of this type of drive, especially at high amplitude velocities, are the problems associated with impact such as vibration, high rate of wear at the impacting surfaces, and fatigue. Also a common problem to previous mechanisms is the vibration and deflection caused by forces reacting to accelerating and decelerating mass of the shuttle and its counter mass. These reacting forces transmit bending moments to the base of the machine causing vibration and deflection of critical members.

SUMMARY OF THE INVENTION

These problems are overcome by the present invention by use of non-linear springs in which the mass spring velocity profile is substantially trapezoidal regardless of the desired amplitude of the velocity. It is highly desirable to achieve a high amplitude of 30 to 40 inches per second trapezoidal velocity profile with minimum power consumption, substantially no friction, wear or vibration.

An improved reciprocating drive made in accordance with this invention moves a hammer bank assembly with a substantially constant velocity within the print region and reverses the direction of the motion quickly to produce a trapezoidal velocity profile. Such a velocity profile is essential for high thruputs in high speed printers.

The mechanism driving the hammer banks employs a plurality of springs operating in parallel to create a nonlinear spring mass system. A spring mass system as such has a trapezoidal velocity profile with round corners. A pair of single action electromagnets, solenoids, or a voice coil electromagnet is servo controlled to compensate for energy losses due to damping, and friction.

An optical switch establishes the zero or the reference position of the hammer banks at midlength of the travel. A velocity transducer measures the velocity at all positions. By integrating the velocity, and adding the integration constant which is established by the optical switch, position is found. Thus positions of hammer banks are constantly monitored for proper dot placements.

A counter mass is reciprocated in phase with the hammer banks but in opposite direction to provide dynamic balance. The reacting forces caused by accelerating and decelerating of the counter mass is substantially in line with the similar reacting forces caused by the motion of hammer banks, thus generating no couples or bending moments.

It is, therefore, a primary object of this invention to provide an improved reciprocating drive capable of reciprocating the hammer banks assembly of a high speed line printer at high and substantially constant velocity within the print region, with minimum turn around time by employing a plurality of resilient strips acting as a highly non-linear spring.

It is also an objective of this invention to provide an improved reciprocating drive of low power consumption by reciprocating a hammer bank at a resonant frequency of a non-linear spring mass system.

Another objective of this invention is to eliminate vibration and bending moments by reciprocating a counter mass in which the line of dynamic force is in line with the line of dynamic force of hammer banks.

Additional objects and advantages will become apparent and a more thorough and comprehensive understanding may be had from the following description taken in conjunction with the accompanying drawings forming a part of this speci- fication.

DETAILED DESCRIPTION OF THE INVENTION

Figure 1:
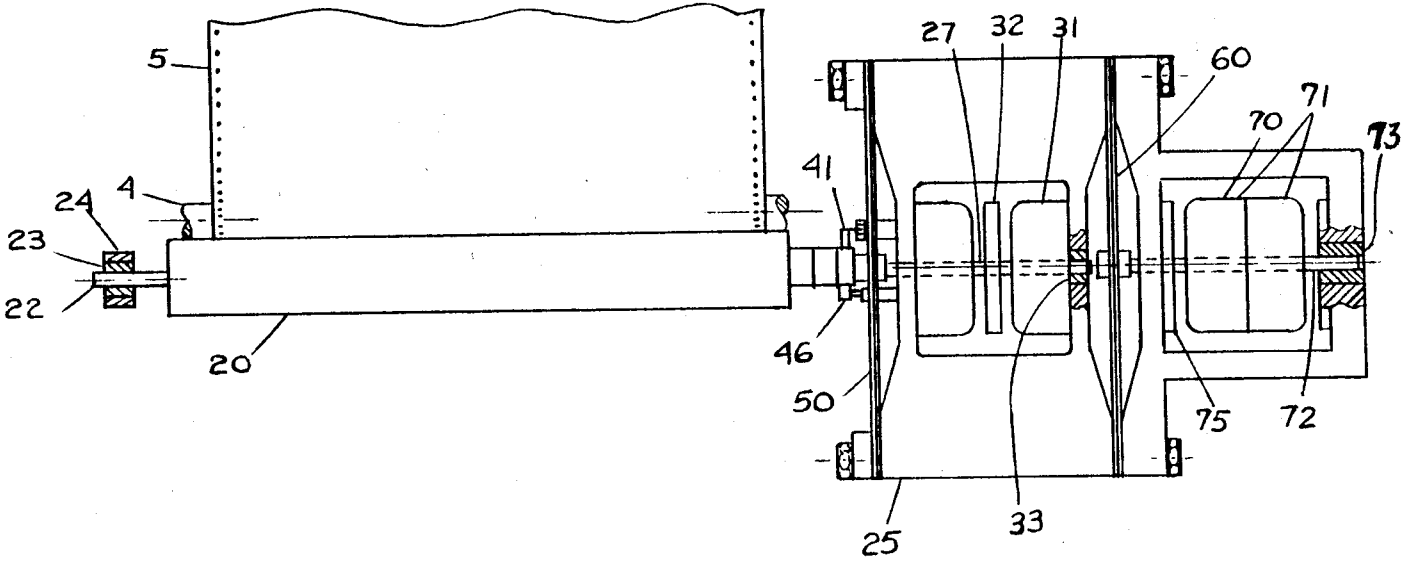
FIG. 1 is a plan view of a first embodiment of the reciprocating drive mechanism of the present invention.
Figure 5:
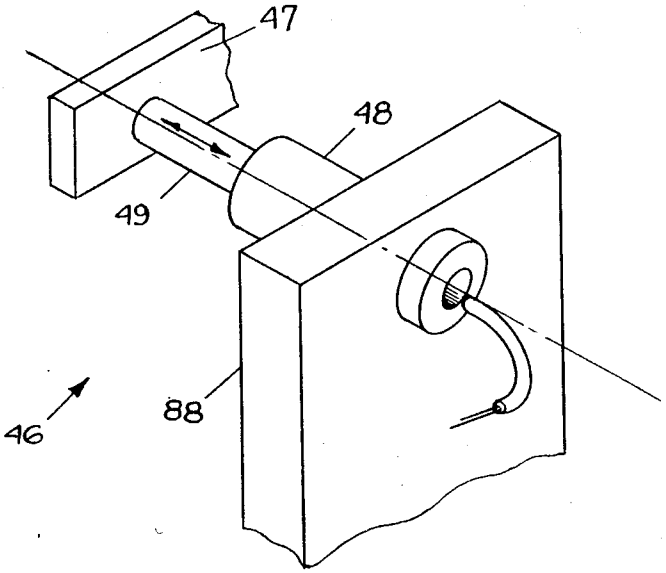
FIG. 5 is a simplified perspective view of the velocity transducer of the present invention.
Figure 4:
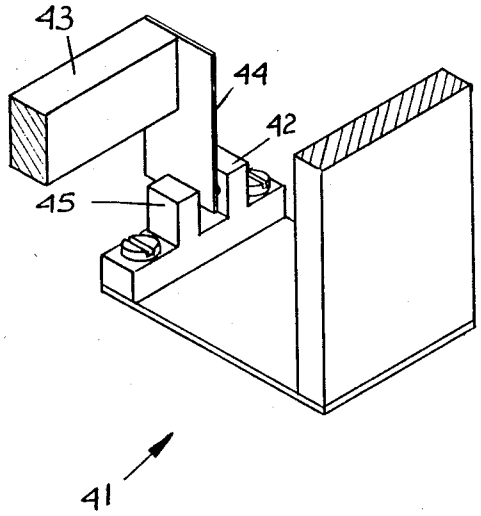
FIG. 4 is a simplified perspective view of the optical switch assembly of the present invention.

Referring now to the drawings, and, more particularly to FIG. 1, an embodiment to be preferred of a reciprocating drive mechanism made according to the present invention is disclosed as incorporated into a dot matrix printer. As paper 5 is advanced upwardly in its contact with a platen 4, a hammer bank 20 is caused to reciprocate by the drive mechanism along the printing line where styli, not shown, of the hammer bank strike a ribbon to print upon the paper, as is conventional in the art. Hammer bank 20 is supported at its free end by a support shaft 22 which is adapted to reciprocate within a linear bearing 23 of bearing block 24, mounted on the base of the machine. A servo control system positions the hammer bank for correct print placement. The servo control system includes an optical switch assembly 41 for establishing a zero reference position, a velocity transducer assembly 46 for measuring velocity, and a servo circuit, as is conventional in the art. While varying types of devices are available, a preferred optical switch, shown in FIG. 4, and a preferred velocity transducer, shown in FIG. 5, are employed.

Optical switch includes a flag 44 attached to the reciprocating hammer bank 20 directly or by attachment bar 43 and a photo diode 45, emitting light sensed by a photo transistor 42, both of which are affixed directly or indirectly to a frame, represented generally by the numeral 25. Velocity transducer assembly 46 includes a magnet bar 49 attached directly to the reciprocating hammer bank 20, or indirectly by attachment bar 47, and a coil 48 attached directly or indirectly to frame 25 by coil housing 83, the coil adapted to reciprocally receive magnet bar 49. As the magnet bar moves through the coil, its change of velocity will induce a voltage in the coil which is analogous to velocity change of the hammer banks from the desired reference velocity. Velocity is integrated by the servo circuit to find the position of the hammer banks. Thus the position of the hammer banks are constantly monitored for proper dot placements.

Depending on the level of dots placements accuracy desired, the velocity transducer may be omitted and the hammers activated at predetermined time intervals referenced to the time the shuttle triggers the optical switch. Although the accuracy of dots placements is compromised, this system may be employed depending on the print application.

Figure 6:
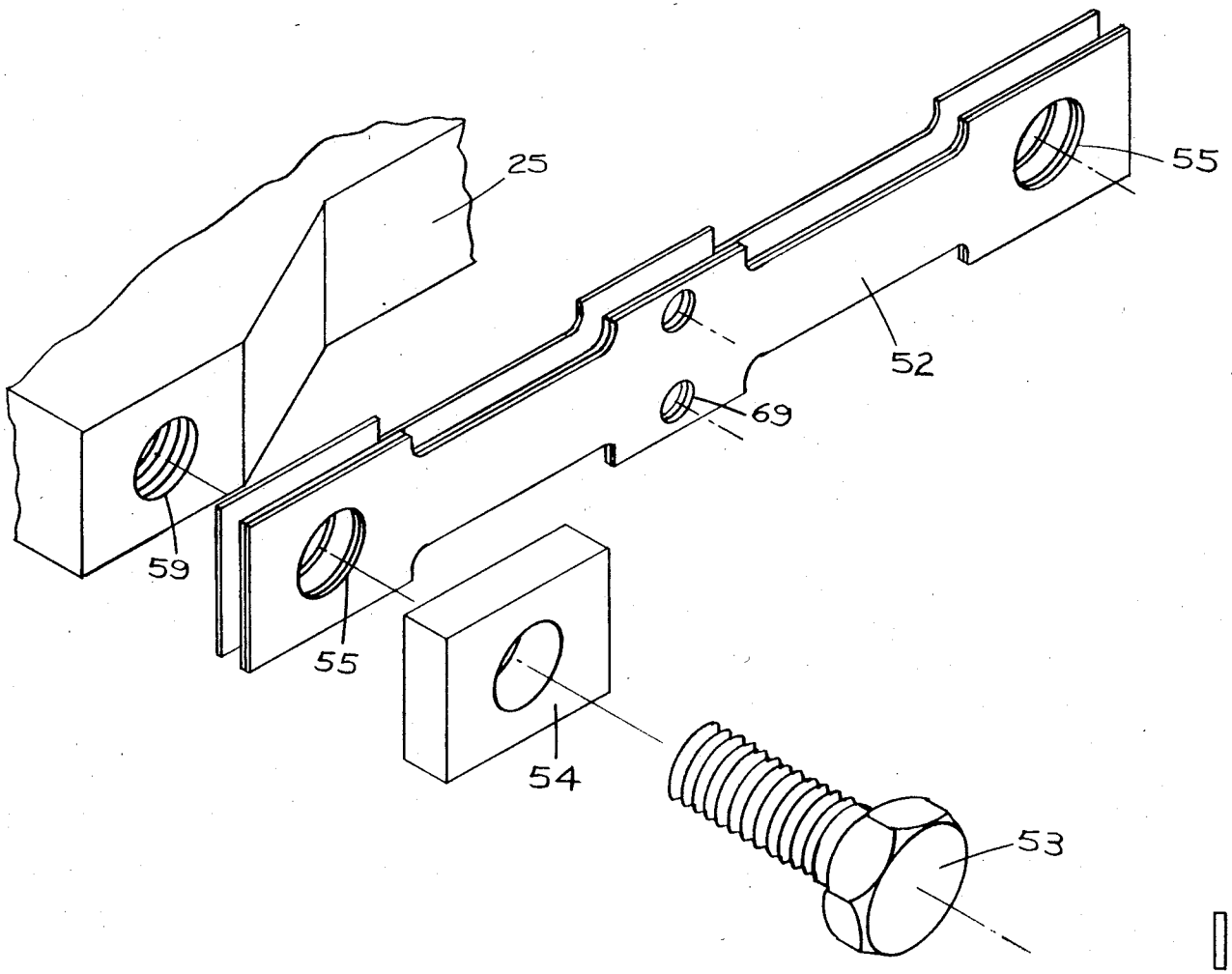
FIG. 6 is a perspective view showing a first embodiment of the spring set of the present invention.

The end of hammer bank 20, opposite its free end, is attached to a non-linear spring set 50, shown to advantage in FIG. 6, and considered a critical element of this invention. Spring set 50, in the embodiment shown in FIG. 6, includes a plurality of elongated resilient strips 52 stacked together, and clamped at both ends of the length to a fixed frame 25, preferably by a bolt 53, extending through a clamp plate 54, through bolt holes 55 in strips 52 and into a threaded aperture 59 in the frame to form a body acting in unison as a non-linear spring. Screw holes 69 may be provided for attachment of solenoid shafts or motor shafts of the drive mechanism to the midlength of the spring set.

Figure 7:
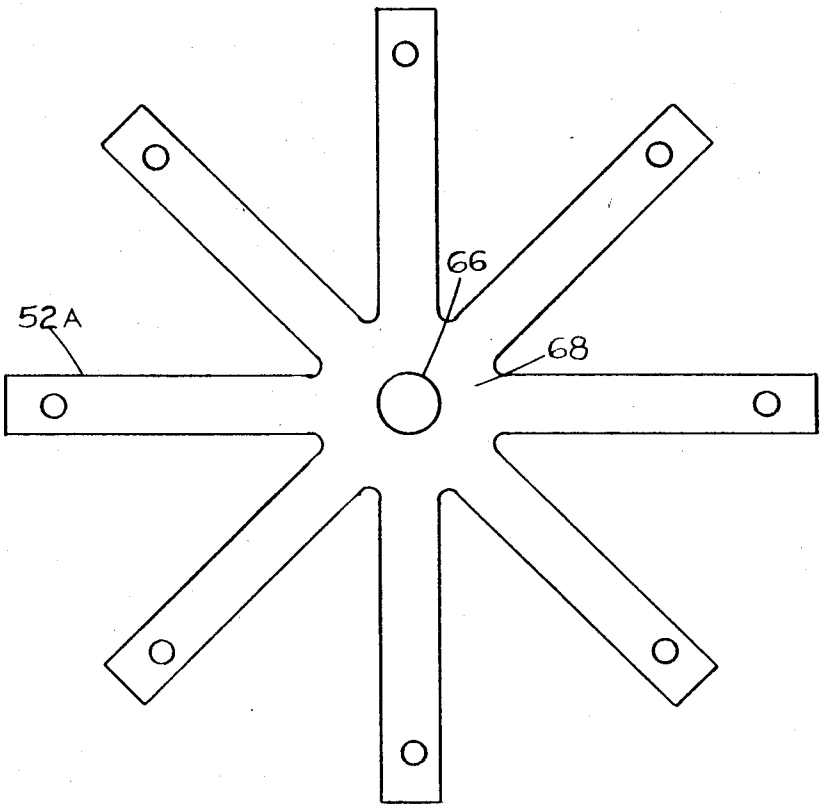
FIG. 7 is a plan view showing a second embodiment of the spring set of the present invention.
Figure 8:
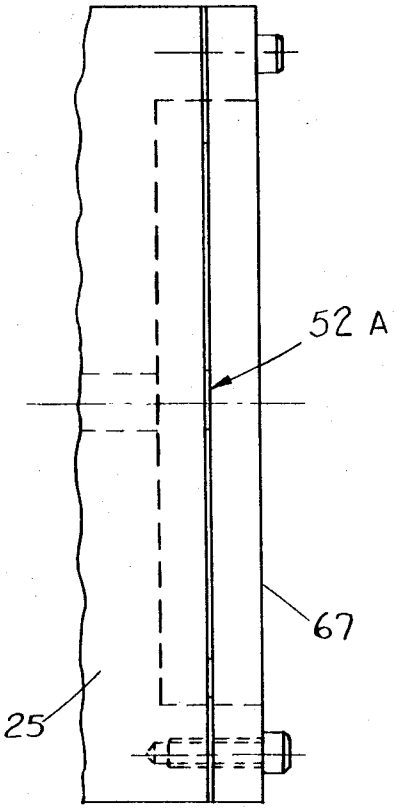
FIG. 8 is a partial side sectional view of the spring set shown in FIG. 7, showing attachment to the frame.

An alternate spring set 50 may be seen in FIGS. 7 and 8. A plurality of elongated resilient strips 52A are joined at midlength to define a hub 68, about which the end of the strips are spaced at regular intervals. The ends of the strips may be clamped, individually or by a common clamping 67 to frame 25, as shown. A screw hole 66 may be provided for attachment of solenoid or motor shafts. The force profile of the non-linear spring set is defined by the equation:

$$F = K X^3,$$

Where:

F is applied force perpendicular to the plane of strips at midlength;

X is a deflection at midlength in a plane perpendicular to the plane of strips; and K is the spring constant defined by physical properties of the strips.

Figure 13:
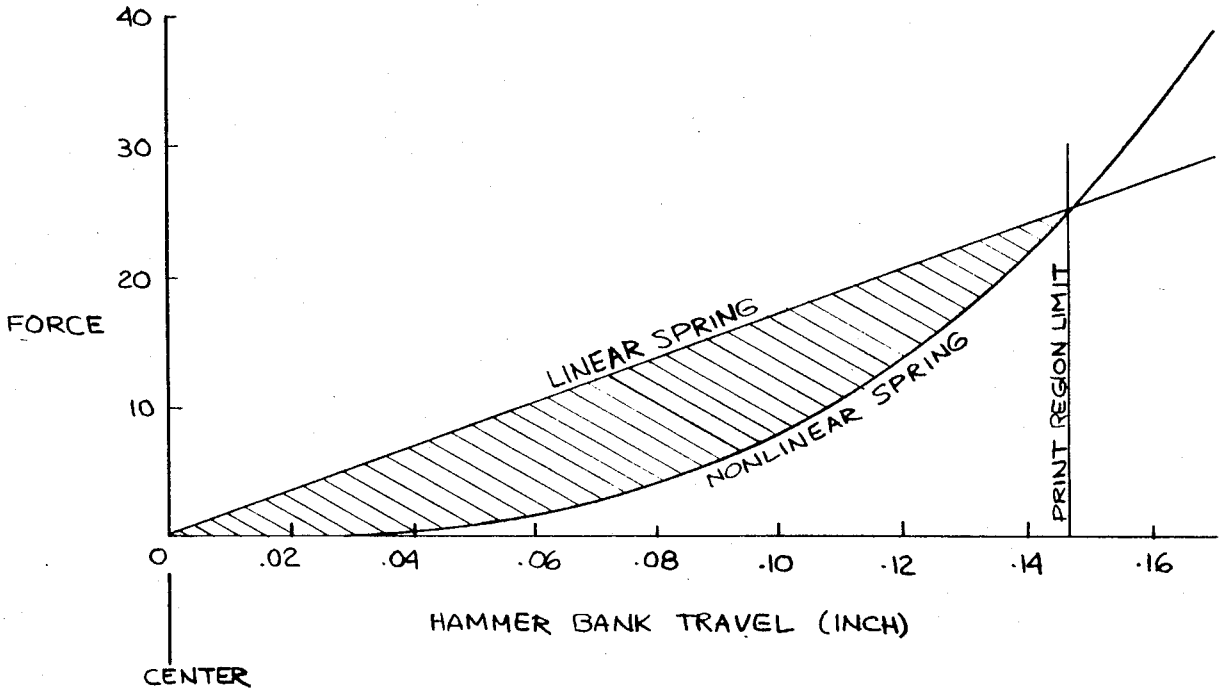
FIG. 13 is a diagram showing the force profile of a non-linear spring set as well as the force profile of a cantilever supported simple flexure representing a linear spring.

A non-linear spring set as such will produce small opposing force to the movement of the hammer bank 20 within most of the print region. As the hammer bank approaches the turn around point the opposing force of the non-linear spring increases at a very rapid rate, thus quickly absorbing the kinetic energy of the hammer bank, reversing its direction, and quickly restoring its kinetic energy. FIG. 13 shows the force profile of the non-linear spring as well as the force profile of a linear spring such as a cantilever supported rectangular flexure which produces the same force as the non-linear spring at the print region limit. The shaded area depicts the undesirable additional force of the linear spring opposing the motion of the hammer banks.

Figure 9:
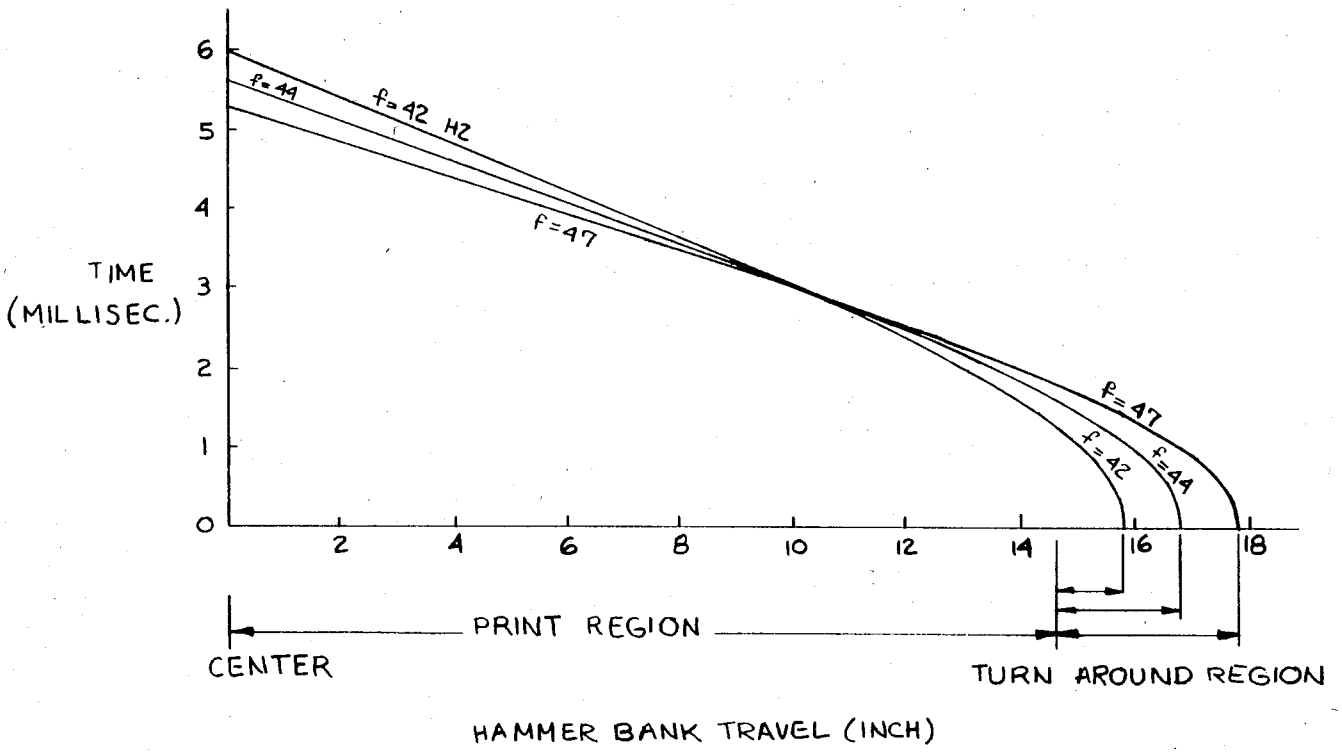
FIG. 9 is a diagram showing displacement profiles for varying travel limits of the hammer bank.
Figure 10:
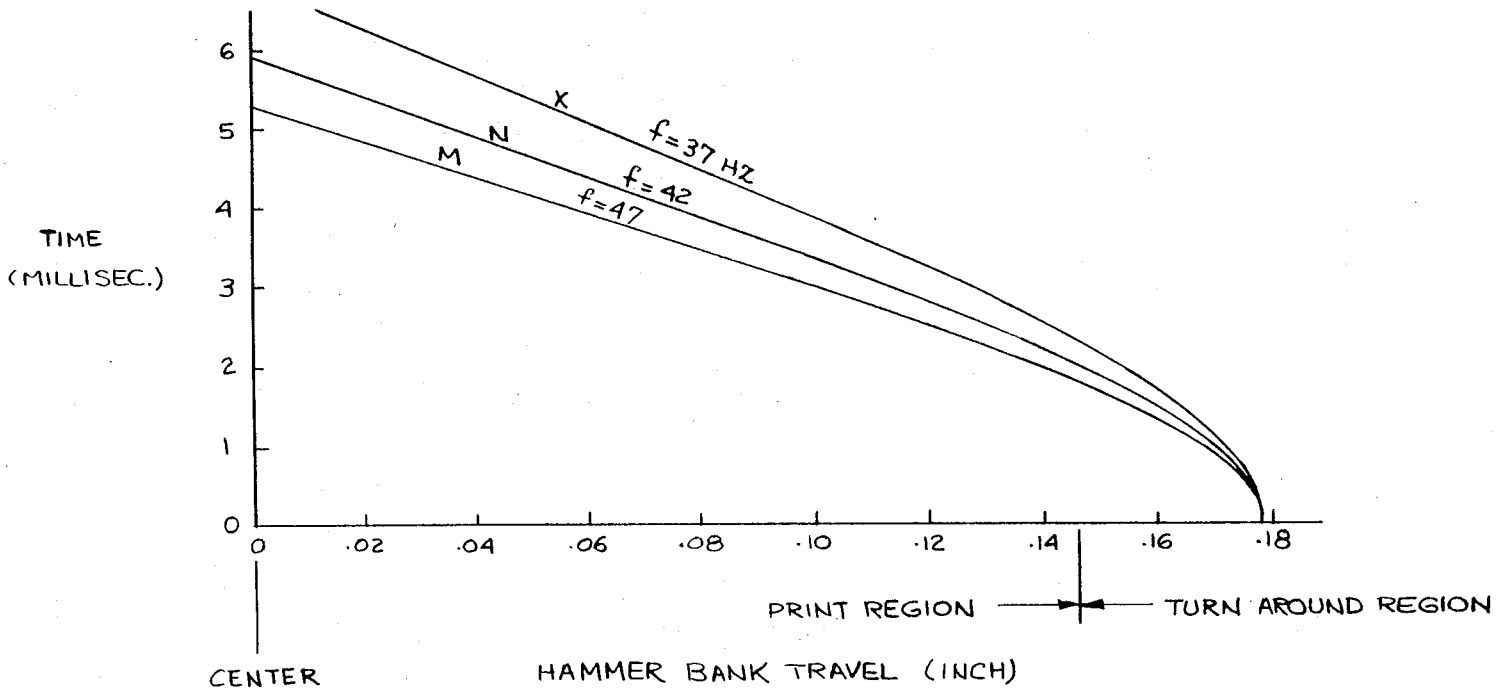
FIG. 10 is a diagram showing the displacement profile of spring sets having varying numbers of resilient strips.
Figure 11:
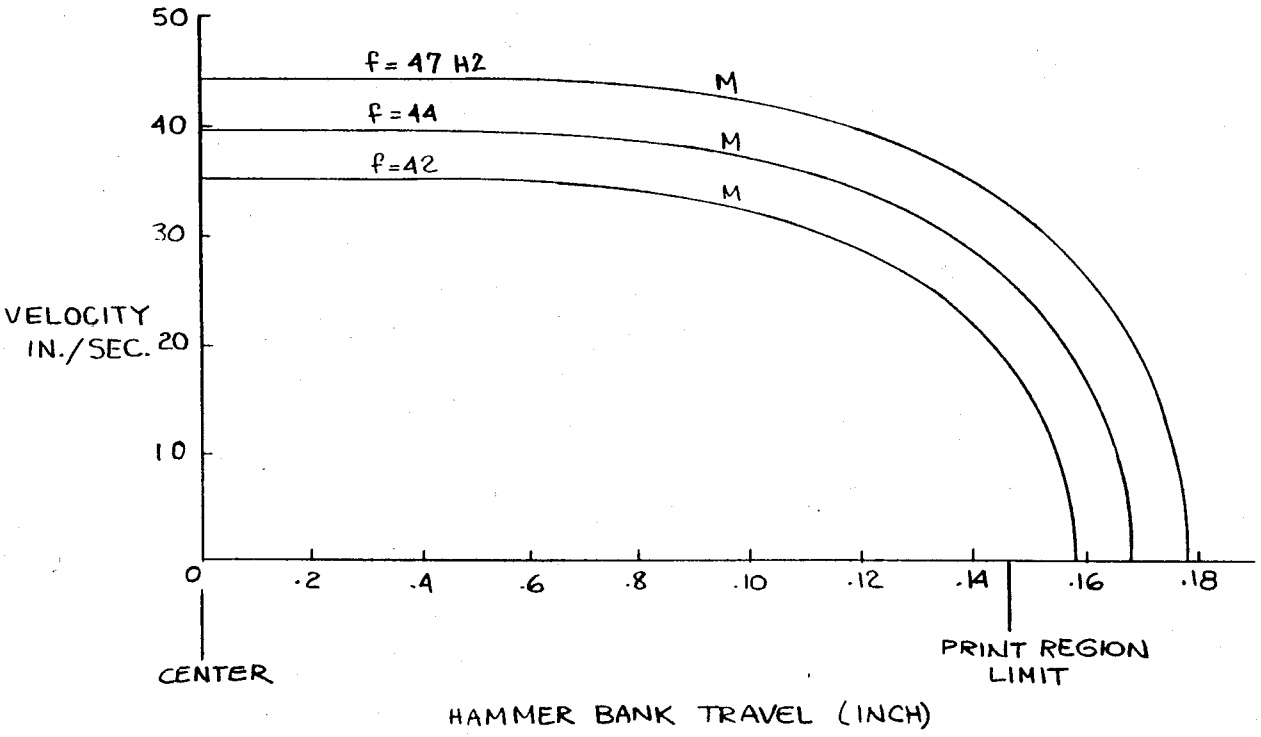
FIG. 11 is a diagram showing the effect of travel limit on the velocity profile.
Figure 12:
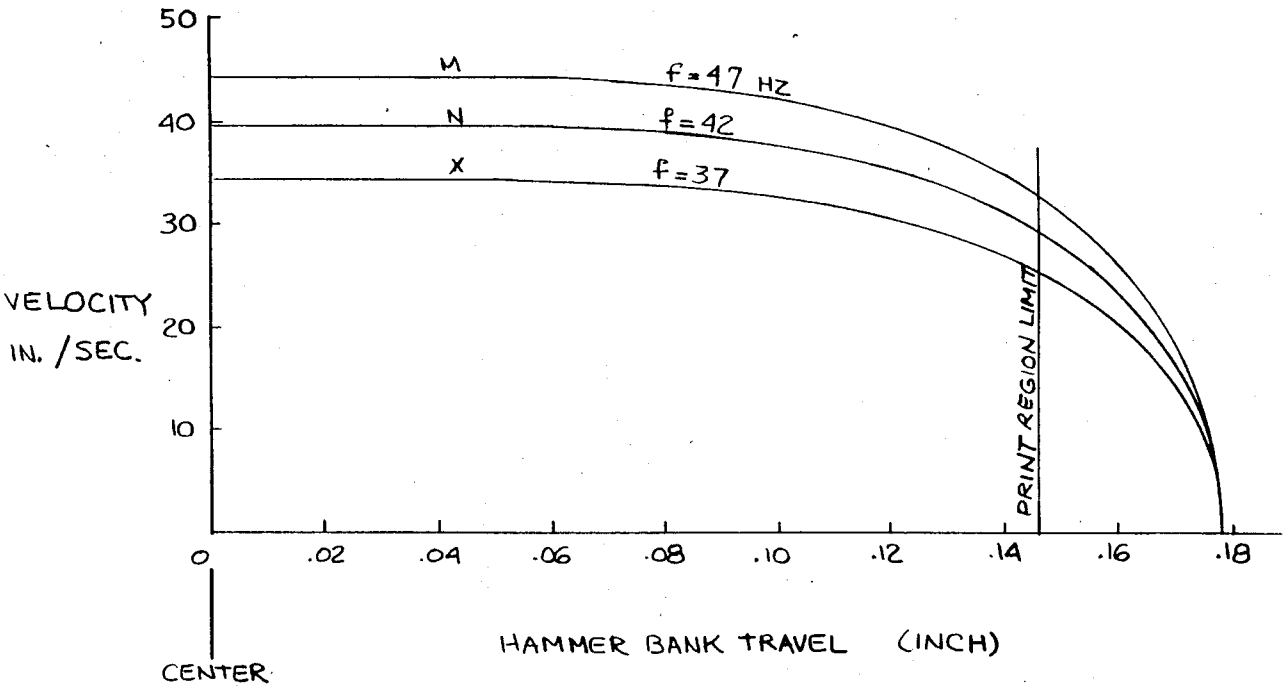
FIG. 12 is a diagram showing the velocity profile of a spring set having varying numbers of resilient strips.

The natural frequency of this non-linear spring mass system varies, depending on the initial deflection of the spring. See FIG. 9, where "f" is the natural frequency. As the amplitude of the undamped free vibration is increased, the turn around travel time increases, but the print region travel time decreases (velocity increases), decreasing the overall cycle time. The turn around time limit is dictated by how fast the paper transport system can move the paper 5 one dot row; the print time is dictated by the maximum operable hammer frequency and the desired dots spacings. If sufficient time is not allowed for either of the said time intervals, dots displacements and impaired print quality would result. On the other hand, allowing intervals longer than necessary would result in loss of thruput. Therefore, for achieving maximum thruput, and good print quality, the velocity profile should satisfy the above criteria. FIGS. 9 thru 12 exemplify a set of guidelines for selecting the proper number of resilient strips per spring set, and proper travel length. FIG. 9 shows the effect of travel limit on the turn around time and the print time. FIG. 10 shows variation of the turn around time, the print time, and subsequently the variation of the natural frequency f as the number of strips (labeled by M, N, or X) of a spring set is changed. FIG. 11 shows the effect of travel limit on the velocity profile of a spring set of M number of strips, and FIG. 12 shows variation of velocity profile as the number of strips (labeled by M, N, or X) of a spring set is changed. For example, if a turn around time of 4 milliseconds, and a velocity of 40 in/sec is needed, velocity profile of a spring set consisting of N number of strips deflected to travel limit of 0.178 inch satisfies the performance criteria. By reciprocating at a natural frequency of this non-linear spring mass system, the need for a relatively powerful, and high response electromagnet actuator is replaced for one(s), which only needs to replace the energy loss due to damping. Of course, for a higher cost of a high voltage power supply, more responsive magnetic actuators and servo circuits, further improvement in the velocity profile may be obtained. The shuttle frequency, therefore, is not necessarily limited to the natural frequency of the spring mass system.

Depending on the type of electromagnets used, and how the system is dynamically balanced, three alternative but preferred embodiments are hereinafter described. Referring now to FIG. 1, a first embodiment of an improved reciprocating drive mechanism of the present invention is shown to advantage. A first pair of solenoids 31, their pole faces facing each other, are fixed to a frame 25. Solenoids 31 share a common armature plate 32 which is mounted on non-magnetic shaft 27. The shaft at one end is secured to midlength of a non-linear spring set 50, and at the opposite end it is supported by a linear bearing 33. The hammer bank assembly 20 is secured at one end to midlength of spring set 50, opposite of the shaft 27, and at the opposite end is supported on shaft 22 by linear bearing 23. When the spring set is at its neutral position, the armature plate 32 is at midway between the pole faces of the solenoids 31. As hammer bank 20 moves to the tight from its midposition, the right solenoid gap narrows, and the right solenoid is servo controlled to remain turned on unless the desired constant velocity is exceeded. At a designated position before the print region limit is passed, the solenoid is turned off to allow the current in the coil to fall substantially before the mass reverses its direction. Similarly, the left solenoid, of FIG. 1 operates in the left side of the travel. When hammer bank 20 moves to the left, the left solenoid remains turned on unless the reference velocity is exceeded, or the turn off position is reached. A second set 60 of elongated resilient strips are fixed to frame 25 similar to the first set 50, to serve as the non-linear spring for the counter mass, said counter mass designated generally by the numeral 70. In that the second set 60 is identical in construction to the first set 50, as shown in FIGS. 6, 7 and 8, further description will not be given. Counter mass 70 comprises a pair of solenoids 71 fixed on a non-magnetic shaft 72 such that their pole faces are at the opposite ends, facing away from each other. The shaft at one end is secured to the midlength of the second spring set 60 and at the opposite end is supported by linear bearing 73. The armature plates 75 of the solenoids are fixed to the frame 25, each facing the pole face of their adjacent solenoid. The total weight of these moving solenoids and their shafts, matches the total weight of the hammer banks and all the other parts fixed to it. The right counter mass solenoid is electrically in parallel with the left hammer bank solenoid, and the left counter mass solenoid is electrically in parallel with the right hammer bank solenoid. Thus the motion of the hammer bank is accomplished by the motion of the counter mass solenoid, in resonance, but in opposite direction to create a dynamic balance.

Figure 2:
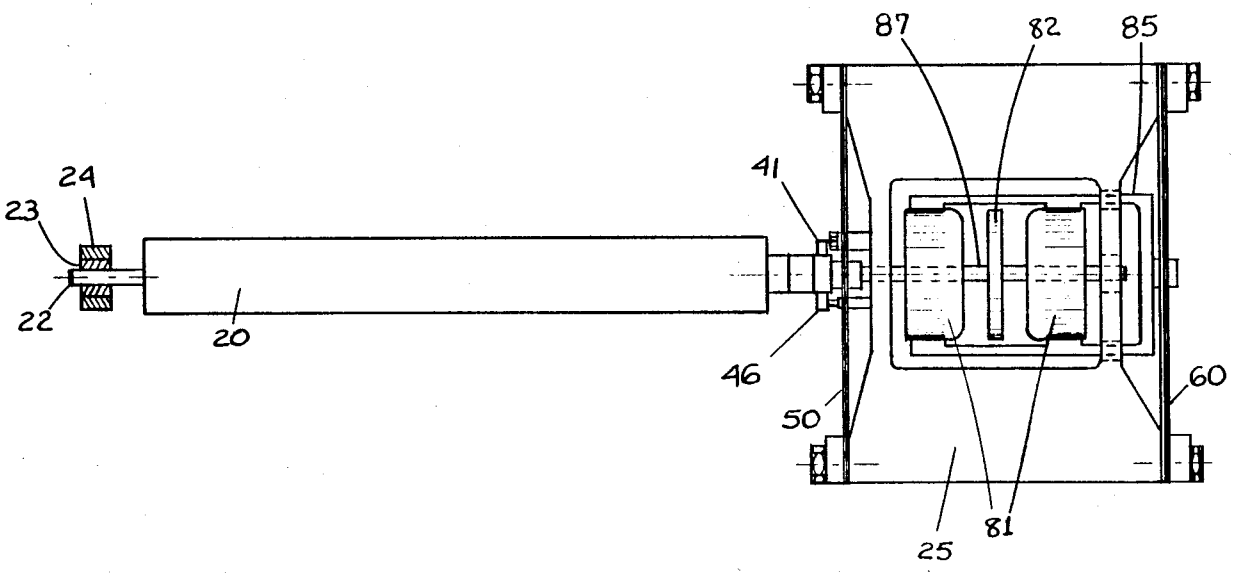
FIG. 2 is a plan view of a second preferred embodiment of the reciprocating drive mechanism of the present invention.

Referring now to FIG. 2, a second preferred embodiment of the drive mechanism of the present invention is shown. Hammer bank 20 and its non-linear spring set 50 and armature plate 82 secured to non-magnetic shaft 87 which in turn is secured to midlength of spring set 50 are assembled similar to the first embodiment, shown in FIG. 1. A pair of solenoids 81 which can slide freely on the shaft 87 of the armature plate are fixed to solenoid frame 85. The opposite end of solenoid frame 85 is secured to the midlength of the second spring set 60. The solenoid pole faces are separated from the armature plate by equal gaps. Each gap is slightly wider than the full length of the hammer bank travel. The total weight of solenoids 81 and their frame 85 serves as a counter weight to the total weight of the hammer bank assembly 20 and the parts fixed to it. The basic operation remains the same as explained in regard to the first embodiment.

Figure 3:
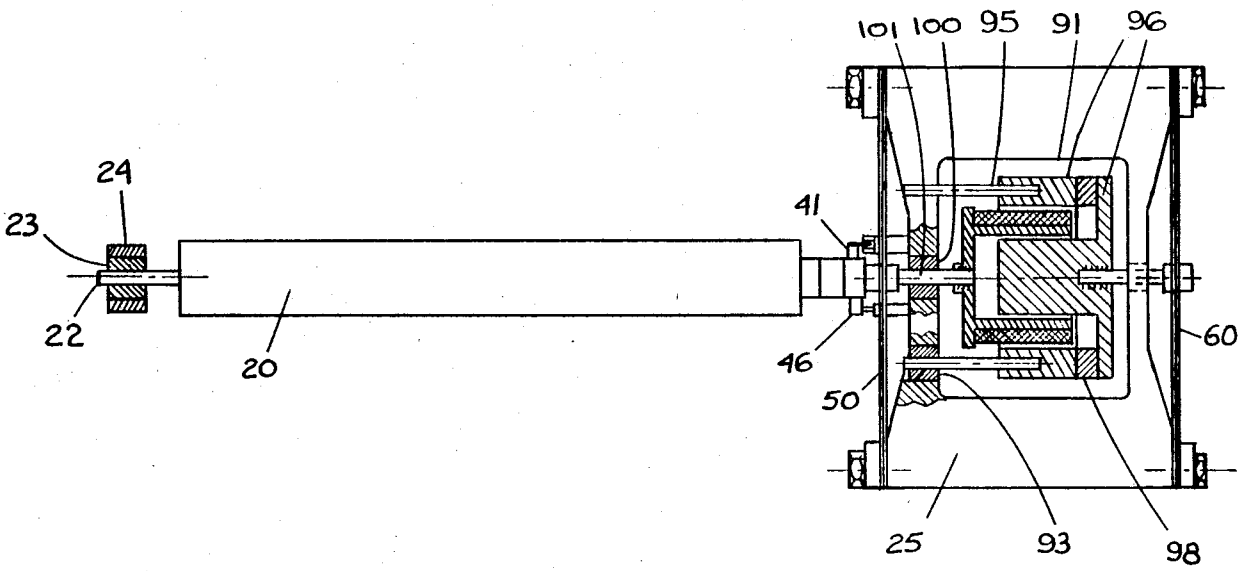
FIG. 3 is a plan view of the third preferred embodiment of the reciprocating drive mechanism of the present invention.

Referring now to FIG. 3, a third embodiment of the drive mechanism of the present invention may be seen. The single action solenoids 81, as described in the second embodiment, are replaced by a double action linear motor, designated generally by the numeral 91, of the voice coil type. Coil assembly 95 of the motor, and the hammer bank assembly 20 are secured to non-linear spring set 50 as in the first embodiment. A linear bearing 100 supports shaft 101 of the coil assembly 95. The remaining structure of motor 91, including permanent magnet 98 and pole pieces 96, at one end is secured to the second non-linear spring set 60, and at the opposite end is supported by linear bearings 93 housed in the frame 25. The two opposite moving masses are made equal to create dynamic balance. The basic operation remains the same as explained in the first and second embodiments.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A reciprocating drive mechanism for printers comprising:

a frame;

a printer hammer bank;

a drive means for reciprocating said hammer bank relative to said frame;

a non-linear spring set comprising a plurality of spring strips, said spring strips being in single or parallel planes with one another and not deflected relative to one another, said spring set secured to said hammer bank and to said frame for reciprocation of said hammer bank by the nonlinear vibration of said spring set; and a servo system for controlling said drive means and for positioning said hammer bank for proper print placement.

2. The mechanism as described in claim 1 wherein said drive means and said non-linear spring set cooperate to reciprocate said hammer bank at a natural frequency of the spring mass system of said non-linear spring set and said hammer bank.

3. The mechanism as described in claim 1 wherein said non-linear spring set comprises a plurality of elongated resilient spring strips affixed to one another.

4. The mechanism as described in claim 3 wherein said elongated resilient spring strips are clamped at both ends of the length to a fixed frame and wherein said hammer bank is attached to said spring set at the midpoint of the length of said strips.

5. The mechanism as described in claim 1 further comprising a counter mass reciprocated in resonance and in opposite direction to said hammer bank for dynamic balance.

6. The mechanism as described in claim 5 further comprising a non-linear spring set attached to said counter mass for reciprocation of said counter mass by the non-linear vibration of said spring set at the same frequency as the frequency of the spring mass system of the hammer bank but in opposite direction.

7. The mechanism as described in claim 6 wherein said non-linear spring set comprises a plurality of elongated resilient spring strips affixed to one another.

8. A reciprocating drive mechanism for printers comprising:

a frame;

a printer hammer bank;

a drive means for reciprocating said hammer bank relative to said frame;

a non-linear spring set including a plurality of resilient spring strips secured together, in a single or in parallel planes and not deflected relative to each other, said spring set secured to said hammer bank and to said frame for reciprocation of said hammer bank by the non-linear vibration of said spring set;

a servo system for controlling said drive means;

a counter mass; and a nonlinear spring set secured to said counter mass and to said frame for reciprocation of said counter mass in resonance and in a direction opposite to the movement of said hammer bank.

9. The mechanism as described in claim 8 wherein said drive means and said non-linear spring sets cooperate to reciprocate said hammer bank at a natural frequency of the spring mass system of said non-linear spring set and said hammer bank.

10. The mechanism as described in claim 8 wherein each of said non-linear spring sets include a plurality of elongated resilient springs secured together.

* * * * *